US005545051A

United States Patent [19]

Summers et al.

[11] Patent Number: 5,545,051

[45] Date of Patent: Aug. 13, 1996

[54] BOARD TO BOARD MATABLE ASSEMBLY

[75] Inventors: Donald J. Summers, Shiremanstown; Robert S. Correll, Jr., Harrisburg; Donald E. Dellinger, Hellan, all of Pa.

[73] Assignee: The Whitaker Corporation, Wilmington, Del.

[21] Appl. No.: 495,951

[22] Filed: Jun. 28, 1995

[51] Int. Cl.[6] ..... H01R 9/09

[52] U.S. Cl. ..... 439/350; 439/65; 439/74; 439/80

[58] Field of Search ..... 439/350

[56] References Cited

U.S. PATENT DOCUMENTS

| | | | |
|---|---|---|---|
| 4,993,965 | 2/1991 | Eck | 439/374 |
| 5,098,311 | 3/1992 | Roath et al. | 439/289 |
| 5,137,462 | 8/1992 | Casey et al. | 439/74 |
| 5,199,884 | 4/1993 | Kaufman et al. | 439/74 |
| 5,224,866 | 7/1993 | Nakamura et al. | 439/81 |
| 5,387,122 | 2/1995 | Goldberger et al. | 439/353 |
| 5,395,250 | 3/1995 | Englert, Jr. et al. | 439/65 |

*Primary Examiner*—P. Austin Bradley
*Assistant Examiner*—T. C. Patel
*Attorney, Agent, or Firm*—Katherine A. Nelson

[57] ABSTRACT

A connector assembly (20) includes a plug connector (22) having a housing (24) and an array of first contacts (40), the housing including latch projections (36) extending laterally from at least both of the opposed sides (30) or both the opposed ends (32) thereof; and a complementary receptacle connector (50) having a housing with a plug receiving cavity (68) and corresponding array of second contacts (70), the housing (52) including latch receiving recesses (66) adjacent the cavity floor (68) alongside at least both of the sidewalls (62) or both of the endwalls (64) corresponding to the sides (30) and ends (32) of the plug portion. During initial mating of the plug and receptacle connectors (22) (50), the latch projections (36 ) of the plug housing (24) bear against and create an interference fit with the adjacent receptacle housing wall surfaces (65) and upon full mating of the plug and receptacle connectors (22) (50), the latch projections (36) release the walls upon their being received in the cavity recesses (66).

18 Claims, 10 Drawing Sheets

BOARD TO BOARD MATABLE ASSEMBLY

FIELD TO THE INVENTION

This invention relates to electrical and more particularly board to board electrical connectors for interconnecting circuits between parallel circuit boards.

BACKGROUND OF THE INVENTION

U.S. Pat. No. 5,395,250 discloses a blind matable miniature connector for interconnecting circuits between parallel circuit boards. The connector in this patent includes surface mountable C-shaped receptacle contacts, each having a spring arm that extends in a direction parallel to the mounting face of the housing and is deflectable in a direction transverse to the axis of mating. The plug has surface mountable L-shaped contacts, each having a post that extends past the spring arm and is in spring biased engagement with the spring arm when the connectors are mated.

U.S. Pat. No. 5,199,884 discloses another connector for interconnecting circuits between parallel circuit boards. The surface mountable receptacle contact in this patent is L-shaped with the post extending toward the mating face of the connector housing. Each of the surface mountable plug contacts includes a base and a U-shaped spring arm having a free end, the spring arm extending toward the mating face of the plug housing. As the receptacle and plug are mated, the free end of the spring arm engages the post of the receptacle contact and is moved inwardly toward the other arm.

With the increased miniaturization of electronic equipment, such as small portable computers and the like it is desirable to have connectors for mother boards and daughter boards that are mated in a parallel configuration. This requires a plurality of connectors on the mother board that must be mated with a corresponding plurality of complementary connectors on the daughter card. These connectors must all be "blind mated". The alignment of a single connector is more readily accomplished than the alignment of multiple connectors during simultaneous mating. Given the close center line spacing of the electrical contacts in these connectors it is extremely important that alignment occur prior to the contacts engaging so that the delicate contacts are not damaged during the mating process.

In manufacturing circuit boards to which multiple connectors are to be mounted, the circuit boards are first provided with arrays of contact pads in the desired locations for the various connectors for interconnecting to the contacts of the various connectors to be secured thereto. Additionally the boards may also be provided with a pattern of precisely dimensioned through-holes or other means for aligning the connectors to the board. The circuit boards are manufactured within the desired or allowed tolerance range for locating the arrays of contact pads with respect to each other and for precisely locating the alignment holes with respect to each array. Despite the precisioned care taken, the problems associated with tolerance build up in mounting multiple connectors to a circuit board are well recognized in the art. The result is that all the connectors mounted to a daughter card may not be precisely aligned with the corresponding complementary connectors on a mother board. Thus when simultaneously mating the plurality of connector pairs on the two boards, the alignment features are provided at the mating faces of the respective connectors to engage and force the respective pairs into alignment for proper mating. Initially this force may be applied or transferred to the soldered connections on the respective boards in conventional arrangements. The stresses applied to the soldered connectors, if maintained after the boards are mated, may be sufficient to break one or more of the soldered connections over an extended period of time, thus adversely affecting the performance of the assembly. The cumulative effect of locating the patterns on the board, placing and securing the connectors on their respective boards each within the allowable tolerance range affects the matability of the multiple pairs of connectors and enhances the chances for misalignment therebetween. It is desirable, therefore, to provide a means whereby each of the connector pairs can be aligned prior to the mating of the contacts. It is further desirable that forces required to align the respective connectors be isolated from the soldered surface mounted connections after the mating has taken place. It is also desirable that any stress to the soldered connections be minimized after the respective connectors have been mated.

SUMMARY OF THE INVENTION

The present invention is directed to solving the problems associated with the blind mating with multiple connector pairs that can be mated simultaneously without damaging the contacts while minimizing stresses on soldered connections between the connectors and their respective circuit boards. Each pair of matable connectors includes a plug connector having a housing with an array of first contacts extending between opposed mating and mounting faces, the mating face being defined on a plug portion of the housing extending between opposed sides and opposed ends; and a receptacle connector having a housing with opposed mating and mounting faces, a bottom wall and a receptacle portion having opposed sidewalls and endwalls defining a cavity adjacent the bottom wall for receiving the complementary plug connector, and having a corresponding array of second contacts extending between the mating and mounting faces. The plug portion and receptacle portion are shaped and dimensioned to interfit snugly upon connector mating.

The plug housing includes latch projections extending laterally from at least both of the opposed sides or both of the opposed ends of the plug portion, and including outwardly facing bearing surfaces extending rearwardly from the mating face. The receptacle housing includes latch receiving recesses adjacent the cavity floor alongside at least both of the sidewalls or both of the endwalls corresponding to the opposed sides or ends of the plug portion, the latch receiving recesses being adapted to receive the latch projections of the plug connector upon full mating thereto. During mating the plug connector to the receptacle connector, the latch projections of the plug housing bear against and create an interference fit with the adjacent housing wall surfaces of the receptacle housing during initial entry of the plug portion into the receptacle portion, thereby holding fixed the centered position of the plug and receptacle connectors to resist lateral forces thereon during mating, and, upon full mating of the plug and receptacle, the latch projections release the walls upon their being received in the cavity recesses.

In another embodiment the receptacle connector is provided with latch projections extending inwardly into the cavity and the plug connector includes corresponding recesses for receiving the projections.

The present invention is also directed to an assembly of interconnectable circuit boards having multiple connector pairs mounted thereto.

The present invention provides a means for mating multiple connector board assemblies simultaneously while minimizing stresses on the soldered connections of the surface mounted contacts. Furthermore the invention provides a greater forgiveness for the locating tolerances in the manufacture of printed circuit boards. The invention also provides greater forgiveness for the placement location of sub-miniature connectors when placing multiple connectors on a single printed circuit board and mating them simultaneously with corresponding sub-miniature connectors on another printed circuit board.

Embodiments of the invention will now be described by way of example with reference to the accompanying drawings.

BRIEF DESCRIPTION OF THE DRAWINGS

FIG. 7 is a cross-sectional view showing the plug and receptacle aligned with each other prior to mating.

FIG. 8 shows the connector of assembly of FIG. 7 partially mated.

FIG. 9 shows the fully mated assembly taken along line 9—9 of FIG. 6.

DETAILED DESCRIPTION OF THE PREFERRED EMBODIMENTS

Figure 1:
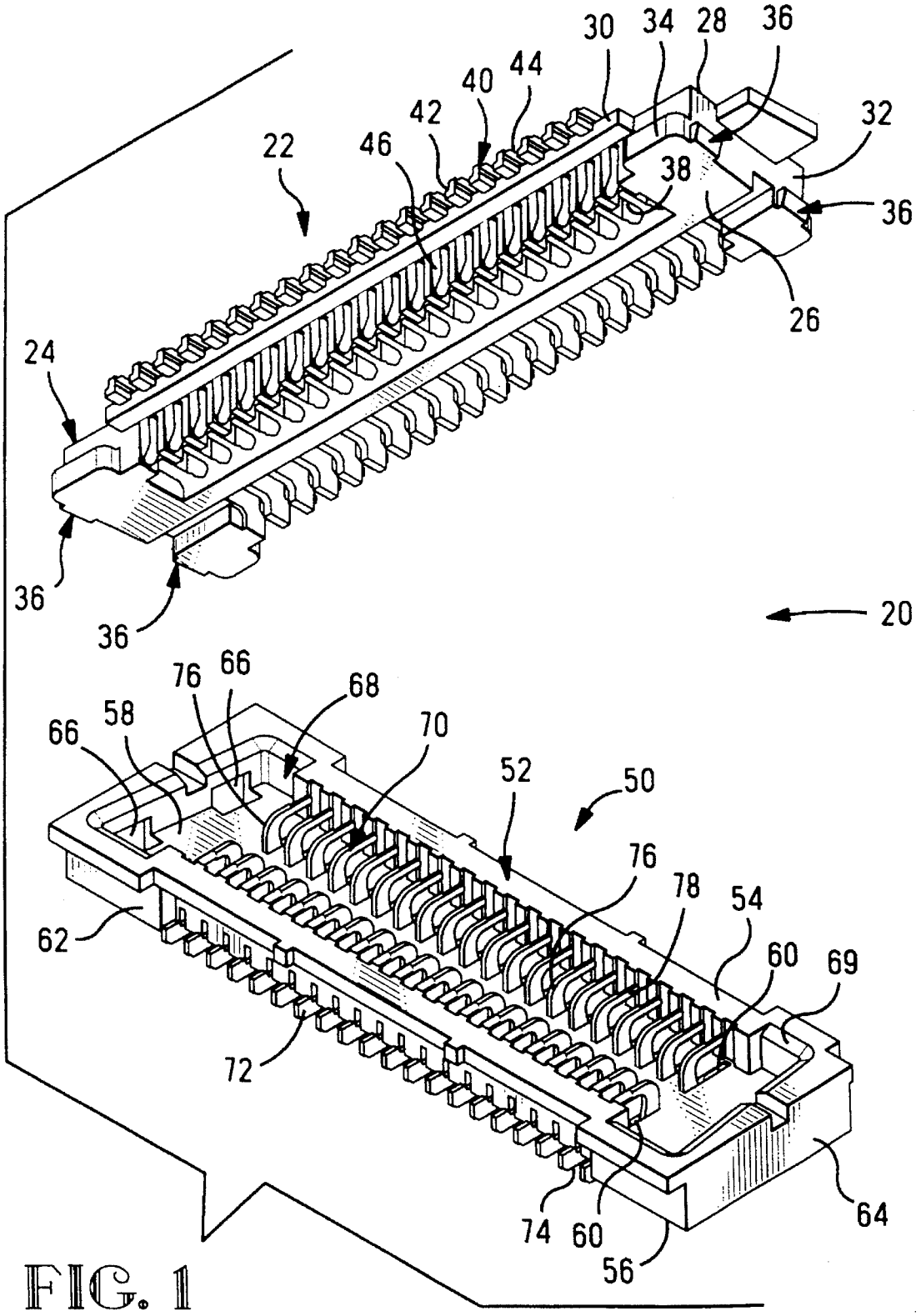
FIG. 1 is a perspective view of the connector assembly of the present invention with the receptacle and plug exploded from each other.
Figure 2:
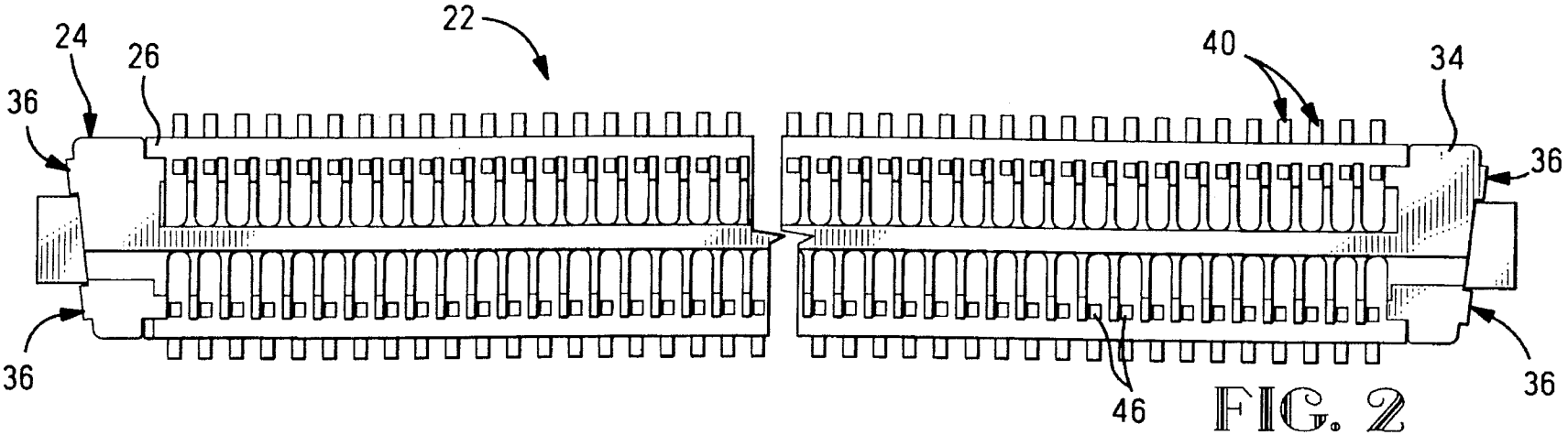
FIG. 2 is a plan view of the mating face of the plug of FIG. 1.
Figure 3:
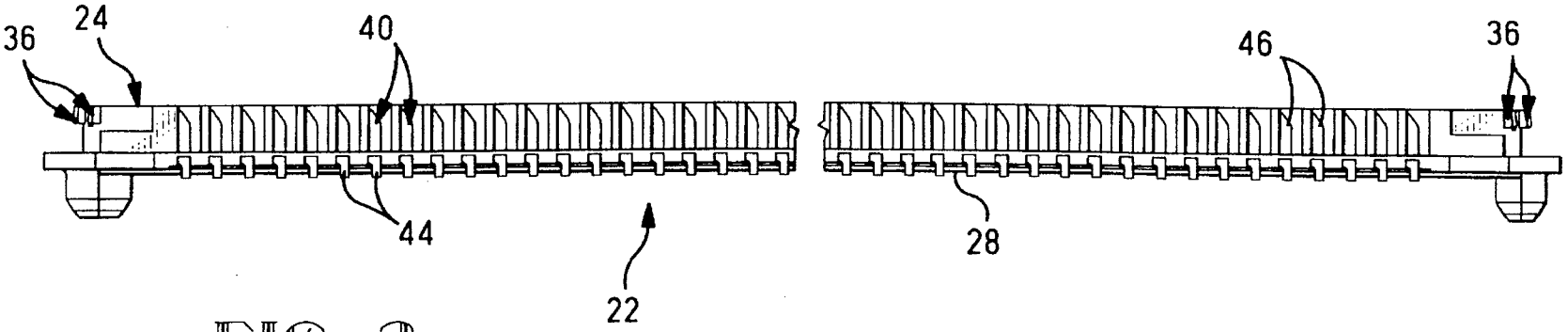
FIG. 3 is a side view of the plug connector of FIG. 1.
Figure 4:
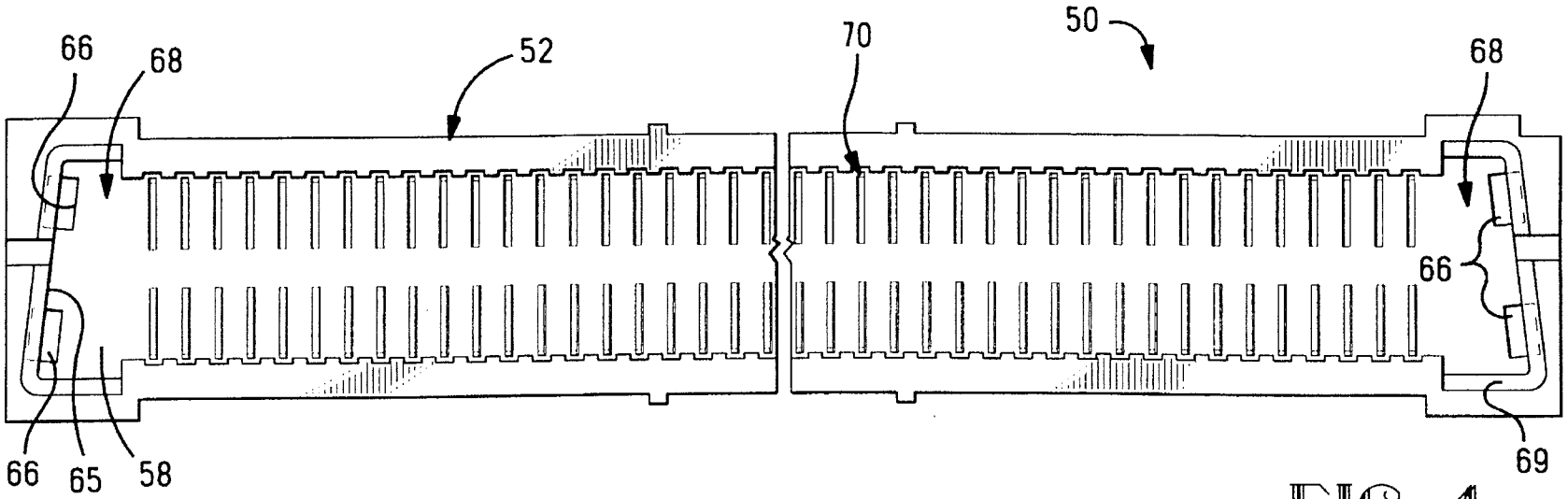
FIG. 4 is a plan view of the mating face of the receptacle connector of FIG. 1.
Figure 5:
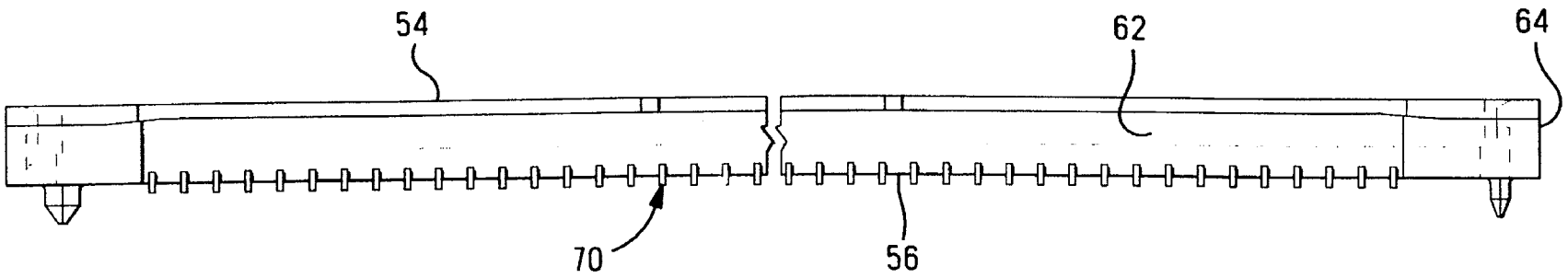
FIG. 5 is a side view of the receptacle connector of FIG. 1.
Figure 6:
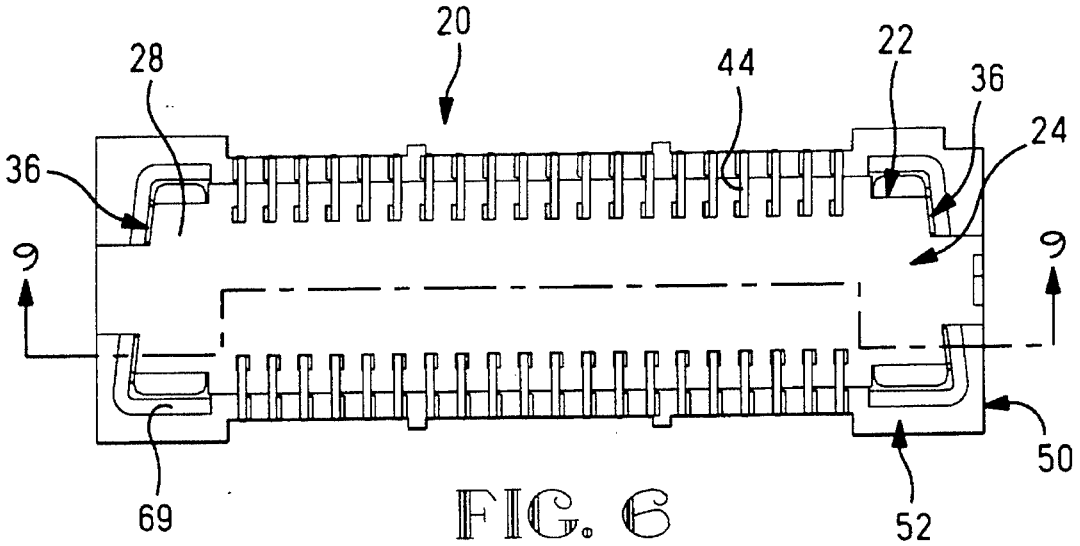
FIG. 6 is top plan view of the mated connector assembly of FIG. 1.

Referring now to FIGS. 1 though 6, connector assembly 20 includes a plug 22 having a plurality of contacts 40 disposed therein and a receptacle 50 having a plurality of contacts 70 disposed therein. Plug 22, as shown in FIGS. 1 through 3 and 6, includes a plug housing 24 having opposed mating face 26 and mounting face 28 and opposed sidewalls 30, and endwalls 32. Endwalls 32 further include flange portions 34 having latch projections 36 extending outwardly therefrom proximate the mating face 26. The contacts 40 are L-shaped and include a base 42 having a surface mount contact surface 44 and a post 46. Contacts 40 are disposed in contact receiving passageways 38 extending between the mating and mounting faces 26, 28 respectively of housing 24.

Receptacle 50 includes a housing 52 having opposed mating and mounting faces 54, 56, a floor 58, and opposed sidewalls 62 and endwalls 64, altogether defining a plug receiving cavity 68. The floor 58 of housing 52 further includes a plurality of contact receiving slots 60 into which are disposed a plurality of C-shaped contacts 70. Receptacle housing 52 further includes latch receiving recesses 66 adjacent the cavity floor 58 alongside the endwalls 64. Recesses 66 are configured to receive the latch projections 36 of the plug connector 22 upon full mating of the plug connector 22 and receptacle connector 50. Contacts 70 include a base 72 having a surface mount contact surface 74 and a spring arm 76 having a first contact portion 78 at the leading end thereof.

Receptacle and plug housings 24,52 respectively are preferably made from a high temperature resistant material such as a liquid crystal polymer or the like. The material selected must be able to withstand temperatures of about 250° C. that are typically achieved during a soldering process, such as infrared reflow soldering or other methods as known in the art.

The plug and receptacle contacts in this embodiment are of the type disclosed in U.S. Pat. No. 5,395,250. The plug contacts 40 are preferably made from metal stock such as phosphor bronze of the like having a thickness of approximately 0.32 mm (0.0126 inches), which preferably has reduced thickness of approximately 0.23 mm to provide the contact edge surface. The receptacle contacts 70 are preferably made from metal stock material having a thickness of approximately 0.15 mm (0.006 inches). The metal selected preferably has a high yield strength in the range of 105–125 thousand p.s.i. to assure that sufficient normal force is achieved in the mated assembly.

Figure 7:
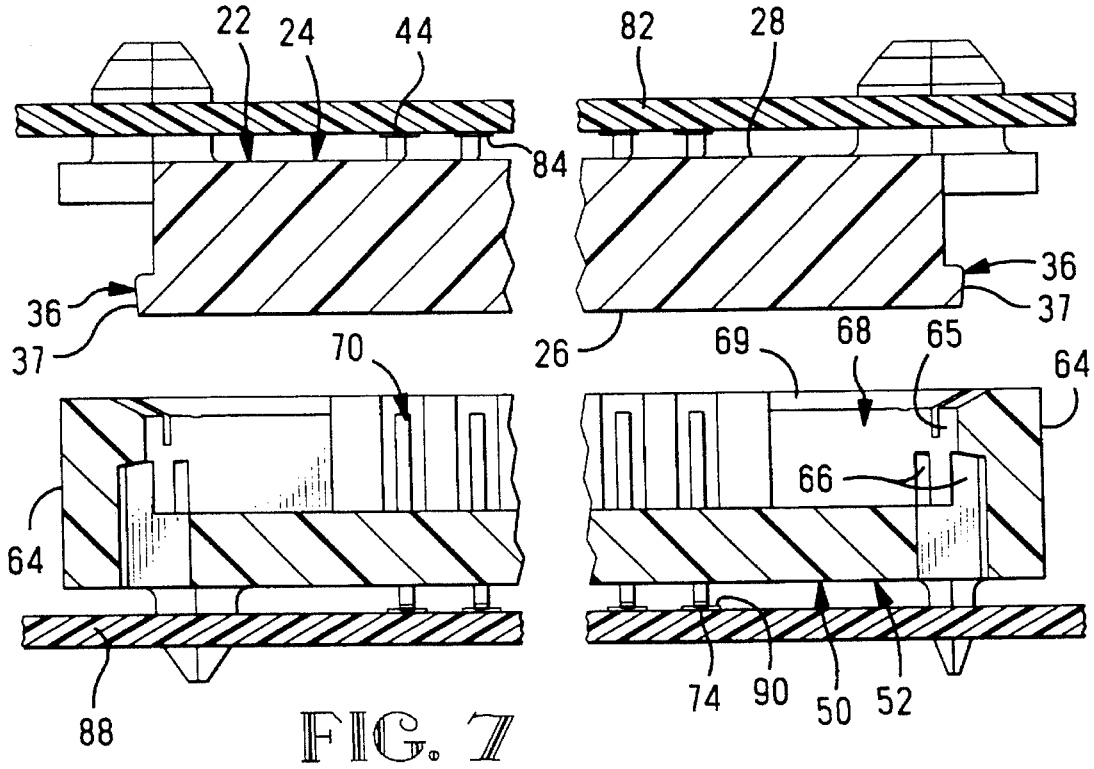
FIGS. 7–9 are cross-sectional view of the connector assembly illustrating the sequence during the mating of the connectors.
Figure 8:
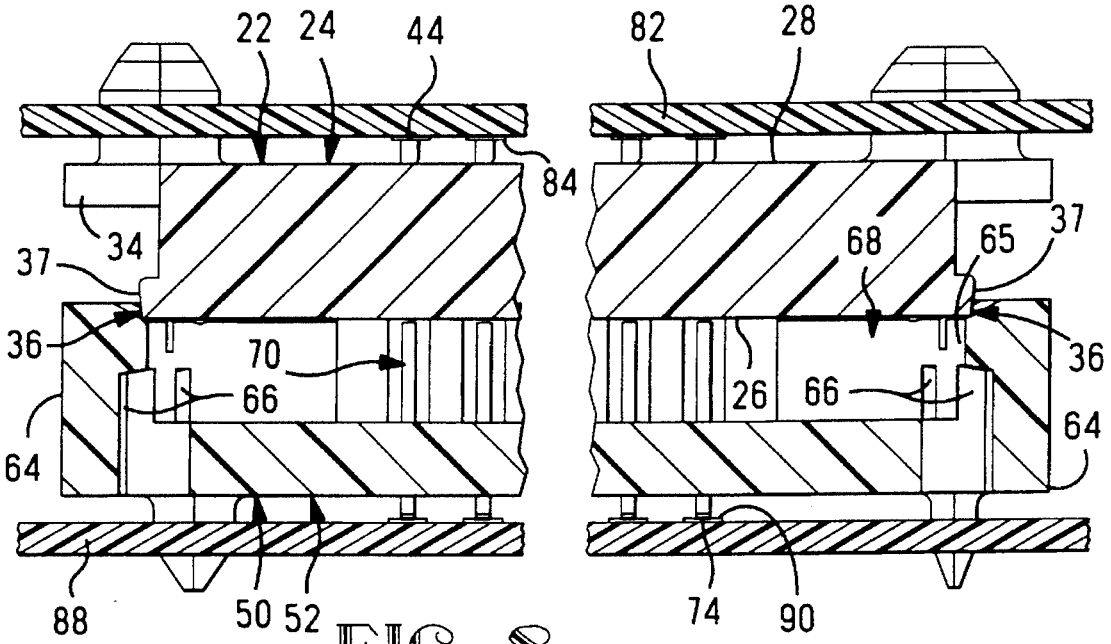
Figure 9:
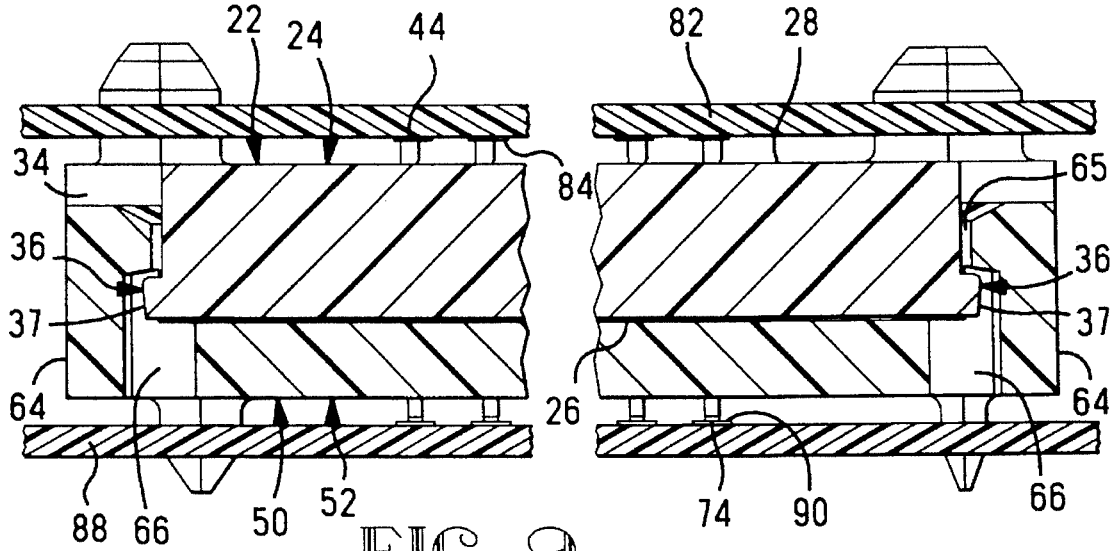

FIG. 7–9 illustrate the mating sequence of the plug and receptacle connectors 22, 50. It is to be understood that at the time of mating each of the respective plug and receptacle connectors are mounted to circuit boards. For purposes of illustrating the invention the circuit boards have been omitted from all but FIG. 9. When aligning the connectors 22,50, each of the respective housings 24, 52, are preferably provided with features that align the housings prior to mating of the contacts 40, 70. In the present invention the flange like portions 34 on the endwalls 32 of the plug housing 24 are received in corresponding configured recesses 66 of the cavity 68 of the receptacle housing 52. The receptacle housing 52 has lead in surfaces 69 which help guide the plug connector 22 into position, and the tapered lead in surfaces 37 on the latch projection 36 help in engaging the latch projections 36 in an interference fit against the endwalls 64 of the receptacle housing 52.

FIG. 7 shows the plug connector 22 aligned for mating with the receptacle connector 50. As the plug connector 22 is moved into engagement with the receptacle connector 22 the latch projections 36 engaged the inner endwall surfaces 65 deflecting the endwalls 64 slightly outwardly as indicated by the arrows to securely position and center the plug connector 22 in the cavity 68 such that the contacts 40, 70 are in alignment prior to engagement thereof.

In accordance with the invention, at least one of the contact arrays is recessed from the mating face to allow the plug housing 24 to be received in the receptacle cavity 68 prior to engagement of the respective pairs of mating contacts 40, 70. As shown in FIG. 8, the housings are properly positioned before the respective contact post 46 engages the spring arm 76 of the mating contacts 40, 70. FIG. 9 shows the plug connector 22 mounted to circuit board 82 and the surface mount contact surfaces 44 of contacts 40 soldered to respective circuit pads 84 thereon. Receptacle connector 50 is mounted to circuit board 88 and the surface mount contact surfaces 74 of contacts 70 are soldered to circuit pads 90 thereon. The respective pairs of plug and receptacle connectors 22, 50 are fully mated with the latch projections 36 received in the latch receiving recesses 66 and the housings 24, 52 are no longer in an interference fit.

As the connectors 22, 50 are brought together in the interference engagement as shown in FIG. 8, stress is placed on the soldered interconnections of surface mounted contacts. This stress is relieved when the plug and the receptacle connectors 22, 50 have been fully mated and latch projections 36 reside in recesses 66, as shown in FIG. 9. Any misalignment between the respective connectors and forces generated thereby is transferred to the deflectable spring arm 76 of the contacts 70 of receptacle housing 52. Thus any forces generated during the alignment are no longer applied to the soldered connections between the respective contacts 44,74 and the contact pads 84,90 of the board to which they are mounted.

Figure 10:
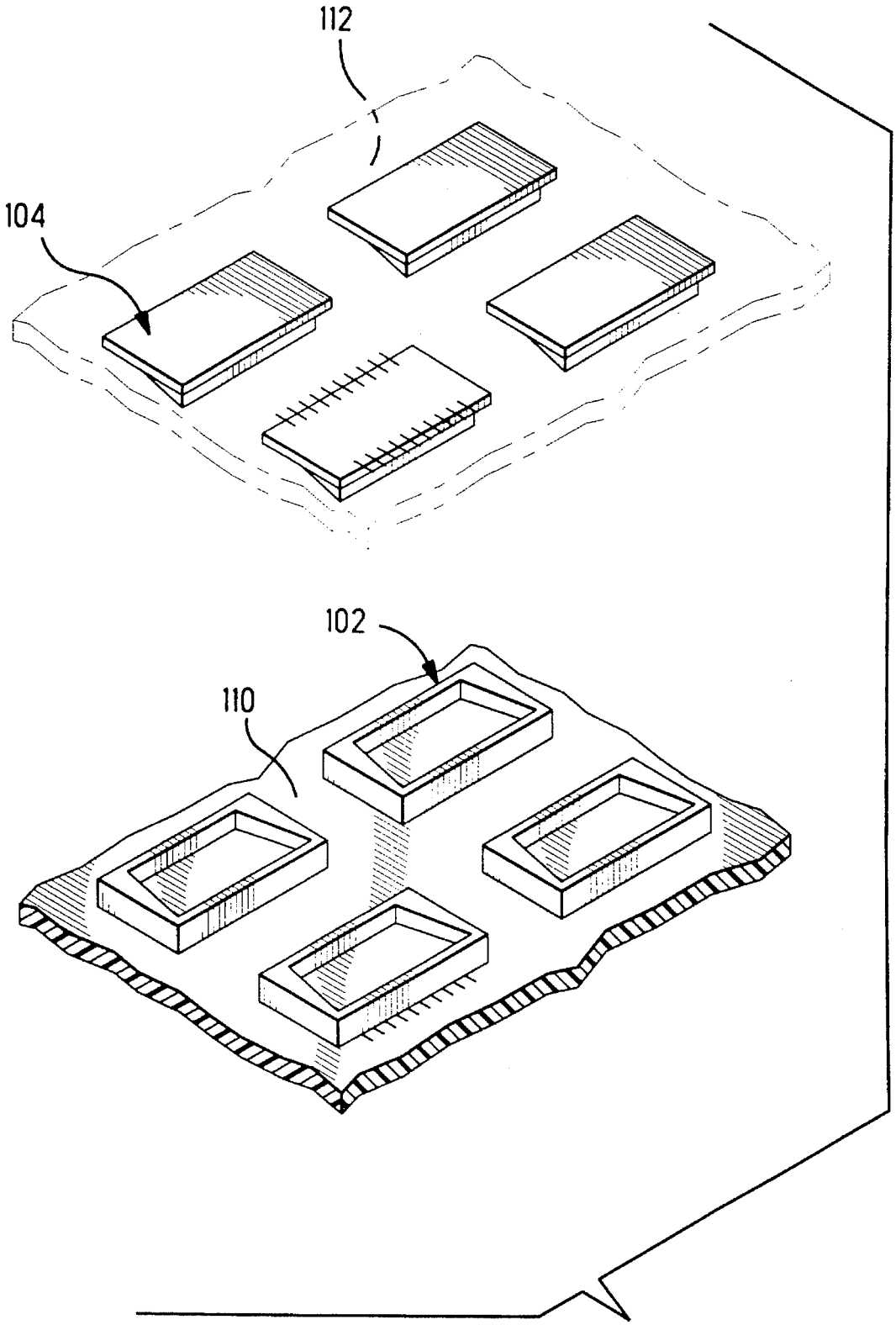
FIG. 10 is a diagrammatic representation of the simultaneous mating of four connectors mounted to respective circuit boards with the daughter card being shown in phantom.

FIG. 10 is a diagrammatic representation of the mating of the plurality of surface mounted connectors 102 mounted to a mother board 110 and plurality of plug connectors 104 mounted to a daughter card 112 as seen through the daughter card which is shown in phantom. One of the connectors 102, 104 on each of the respective boards 110, 112 is shown with representative surface mounted contacts which are soldered to the respective circuit board pads. For purposes of clarity the surface mount contacts have been omitted from the remaining connectors 102, 104 on the boards. This representation illustrates how the tolerance ranges that are present at the various steps in the manufacturing process can affect the matability of the multiple connector pairs. The cumulative effect of all the tolerances allowed in the placement of the arrays of circuit board contact pads for each of the connectors, the locations of the alignment holes or other alignment features, and the actual securing of the connectors to the boards contribute to the build up. The result is that all the connectors mounted to a daughter card may not be precisely aligned with the corresponding complementary connectors on a mother board.

The present invention alleviates the problems associated with tolerance build up by providing, in addition to alignment features, latch projections 36 at the plug mating face that engage the inner receptacle wall surfaces at the mating face thereof to engage in an interference fit with receptacle walls and force the respective connector pairs into alignment for proper mating. Upon full mating of the connector pairs, the tapered latch projections 36 on the endwalls of the plug connector move out of the interference fit and into the latch receiving recesses 66 of the plug receptacle connector. Thus the housings 24,52 are allowed to float relative to each other while any alignment stresses applied for alignment purposes is transferred to the resilient contact spring arm or beams 76 rather than to the soldered connections. The spring arms 76 deflect more readily than the plastic housings, thereby protecting the soldered surface mounted contact portions. The resultant transfer of force applied to deflect the contact beams may cause the mating surfaces of the post 46 and the beams 78 to be shifted. If the respective connector housings 24,52 shift with respect to the width of the housings after the forces are transferred, the plug post 46 will shift along the length of the beam 78. A shift in the lengthwise direction of the connector housings 24,52 after the forces are transferred will increase the normal force between the contacts 40 and 70 in one row of the connectors and decrease the normal force between the contacts on the other side of the connector owing to the particular structure of the connectors shown in FIG. 1.

The material selected for the contacts of the respective connectors must be such that sufficient normal force will remain within the desired operating range. The spring member must be of material that can operate despite a certain degree of additional or less deflection within a specific tolerance range.

Figure 11:
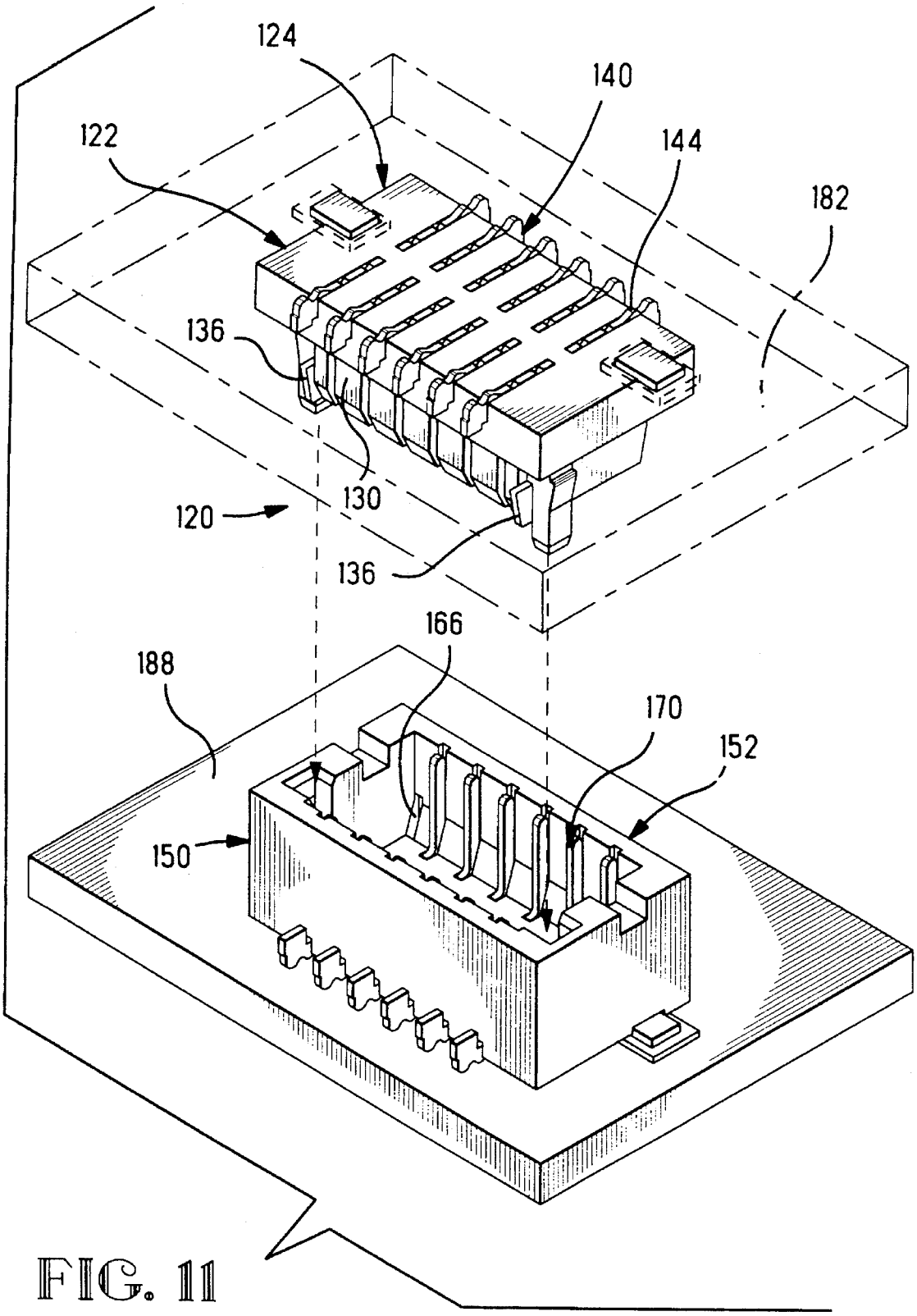
FIG. 11 is a perspective view of another embodiment of the connector assembly made in accordance with the present invention with the receptacle and plug mounted to respective circuit boards and exploded from each other, the one board being shown in phantom.
Figure 12:
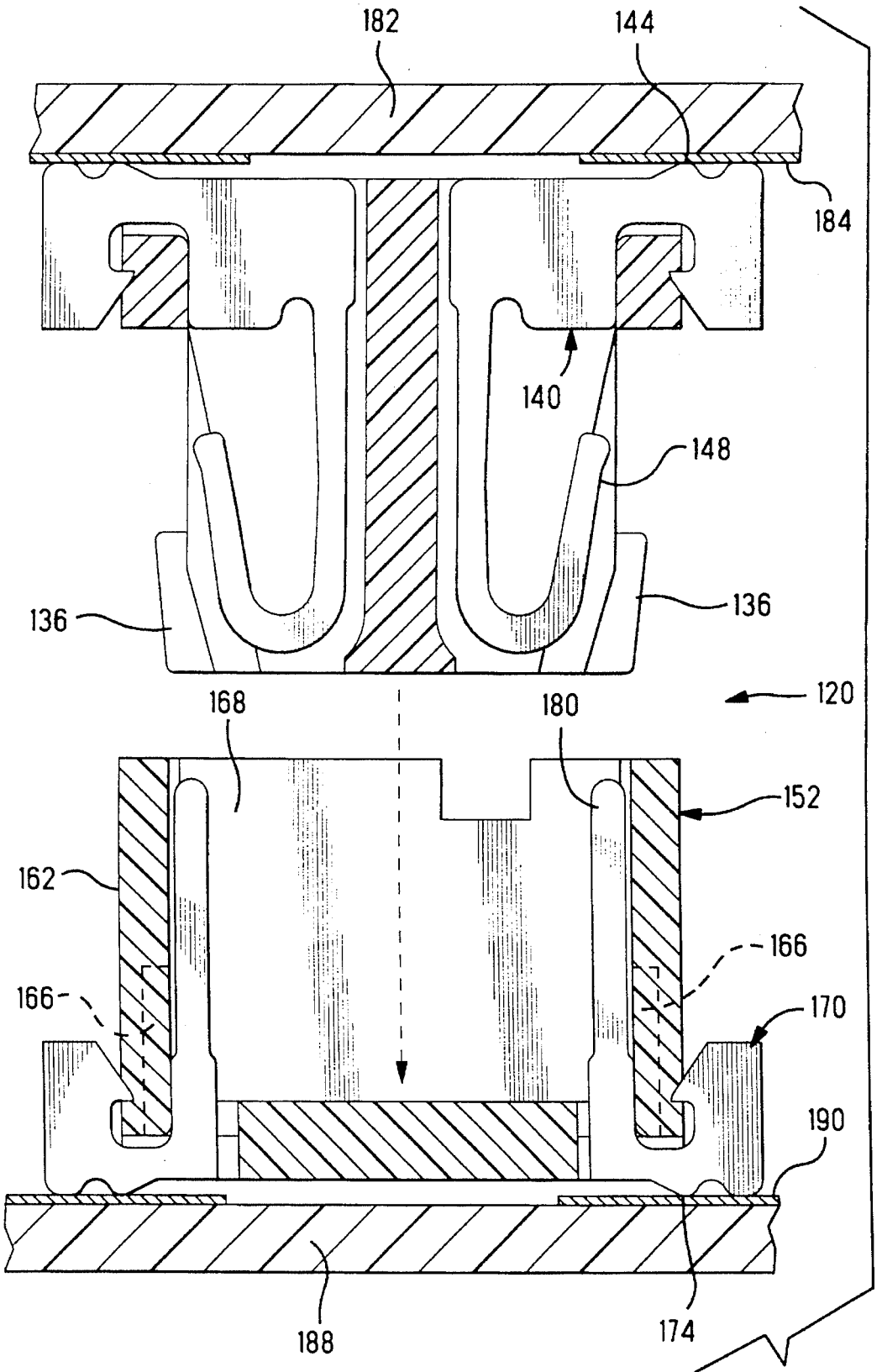
FIG. 12 is a cross-sectional view showing the plug and receptacle of FIG. 10 aligned with each other prior to mating.

FIGS. 11 and 12 show an alternative embodiment 120 of a connector pair 122,150 each mounted to respective circuit boards 182,188 and having surface mounted contact surfaces 144,174 respectively secured to circuit pads 184,190. In this embodiment the latches 136 on plug 122 are on the sidewalls 130 and the latching recesses 166 of the receptacle connector 152 are along the sidewalls 162. Each contact 140 in the plug connector 122 has a deflectable beam portion 148 that extends in a direction parallel to the mating axis of the connectors. Upon deflection, the beam portions move in a direction parallel to the width of the connector housing. The receptacle contact has a post 180. The plug and receptacle contacts in this embodiment are of the type disclosed in U.S. Pat. No. 5,199,884.

Figure 13:
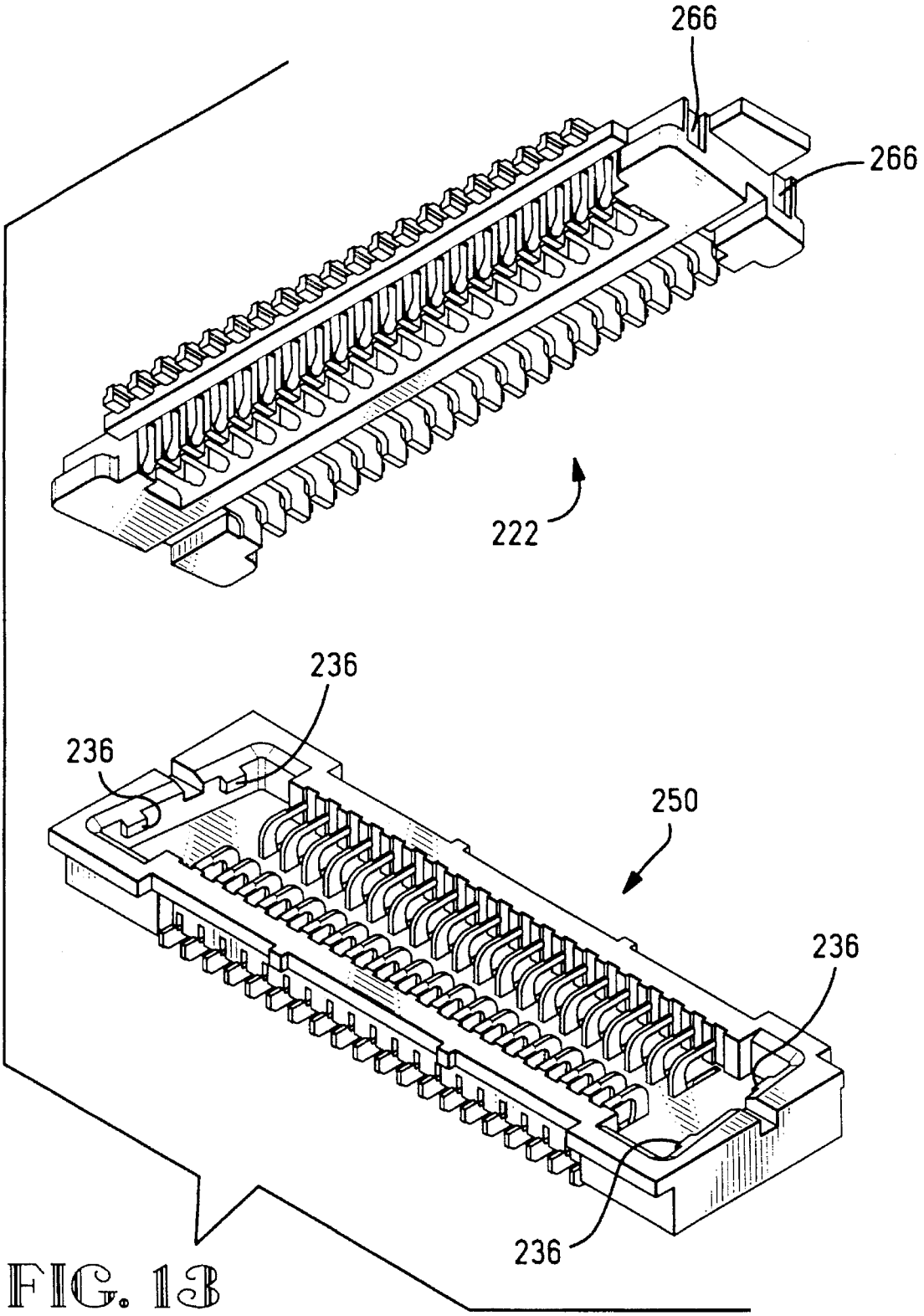
FIG. 13 is a perspective view of another alternative embodiment of the connector assembly of the present invention with the receptacle and plug exploded from each other.
Figure 14:
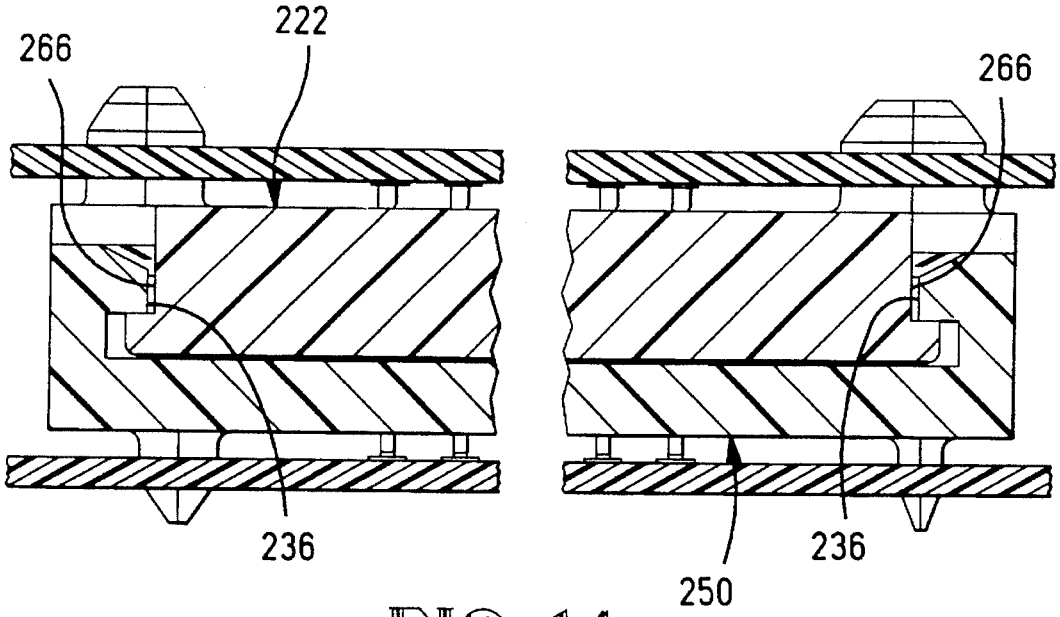
FIG. 14 shows the fully mated assembly of the embodiment of FIG. 13.

FIGS. 13 and 14 illustrate another embodiment 220 of the invention in which the receptacle connector 250 is provided with latch projections 236 extending inwardly into the cavity along the ends and the plug connector 222 includes corresponding recesses 266 for receiving the projections 236.

It is to be understood that the contacts of either of the plug or the receptacle may have the deflectable beams. Additionally both the plug and the receptacle may have deflectable beams. It is preferred that one or both of the respective arrays of contacts be recessed from the mating face of the respective housing to assure alignment of the connector housings prior to mating of the contacts. Also a circuit board may have both plug and receptacle connectors, as long as the other circuit board is provided with connectors complementary therewith.

It is to be further understood that either the plug or receptacle connectors may have more than one projection on both sides or both ends or may include projections on both sides and both ends. Concomitantly the mating receptacle or plug connectors will have the corresponding number of recesses. The number and location of the projections and recesses will depend on the size and configuration of the connector.

It is thought that the electrical connector of the present invention and many of its attendant advantages will be understood for the foregoing description. It is apparent that various changes may be made in the form, construction, and arrangement thereof without departing from the spirit or scope of the invention, or sacrificing all of its material advantages.

We claim:

1. A surface mountable connector assembly for interconnecting circuits of respective circuit boards comprising:

a plug connector having a housing with opposed mating and mounting faces and an array of first contacts extending therebetween, said first contacts having mating portions exposed at said mating face for mating with complementary contacts of a mating connector, said mating face being defined on a plug portion of said housing extending between opposed sides and opposed ends;

a receptacle connector having a housing with opposed mating and mounting faces, a bottom wall and a receptacle portion having opposed sides and opposed ends defining a cavity adjacent said bottom wall for receiving said complementary plug connector and a corresponding array of second contacts extending between said mating and mounting faces, said plug portion and receptacle portion being shaped and dimensioned to interfit snugly upon connector mating;

one of said plug portion and said receptacle portion includes at least two spaced apart latch projections extending laterally from at least both of said opposed sides or both of said opposed ends, and including outwardly facing bearing surfaces adjacent bearing surfaces of the other of said plug portion and receptacle portion; and the other of said plug portion and said receptacle portion includes at least two spaced apart latch receiving recesses alongside at least both of said sides or both of said ends corresponding to said opposed sides or ends of one of said plug portion and said receptacle portion having said projections, said latch receiving recesses being adapted to receive said latch projections upon full mating thereto;

whereby during mating said plug connector to said receptacle connector, said latch projections bear against and create an interference fit with said adjacent bearing surfaces during initial entry of said plug portion into said receptacle portion, thereby holding fixed the centered position of the plug and receptacle connectors to resist lateral forces thereon during mating and upon full mating of said plug and receptacle connectors, said latch projections release said walls upon their being received in said cavity recesses.

2. The surface mountable connector assembly of claim 1 wherein said latch projections and said latch receiving recesses are proximate corners of the opposed sides or opposed ends of said respective plug and receptacle portions.

3. The surface mountable connector assembly of claim 1 wherein said bearing surfaces of said latch projections are continuously tapered forwardly and inwardly from said latch surface.

4. The surface mountable connector assembly of claim 1 wherein ones of said latch projections on the opposed sides or the opposed ends are aligned with each other.

5. A surface mountable connector assembly for interconnecting circuits of respective circuit boards comprising:

a plug connector having a housing with opposed mating and mounting faces and an array of first contacts extending therebetween, said first contacts having mating portions exposed at said mating face for mating with complementary contacts of a mating connector, said mating face being defined on a plug portion of said housing extending between opposed sides and opposed ends;

a receptacle connector having a housing with opposed mating and mounting faces, a bottom wall and a receptacle portion having opposed sidewalls and opposed endwalls defining a cavity adjacent said bottom wall for receiving said complementary plug connector and a corresponding array of second contacts extending between said mating and mounting faces, said plug portion and receptacle portion being shaped and dimensioned to interfit snugly upon connector mating;

said plug housing includes at least two spaced apart latch projections extending laterally from at least both of said opposed sides or both of said opposed ends of said plug portion, and including outwardly facing bearing surfaces extending rearwardly from said mating face; and said receptacle housing includes at least two spaced apart latch receiving recesses adjacent said cavity floor alongside at least both of said sidewalls or both of said endwalls corresponding to said opposed sides or ends of said plug portion, said latch projections of said plug portion, said latch receiving recesses being adapted to receive said latch projections of said plug connector upon full mating thereto;

whereby during mating said plug connector to said receptacle connector, said latch projections of said plug housing bear against and create an interference fit with said adjacent housing wall surfaces of said receptacle housing during initial entry of said plug portion into said receptacle portion, thereby holding fixed the centered position of the plug and receptacle connectors to resist lateral forces thereon during mating and upon full mating of said plug and receptacle connectors, said latch projections release said walls upon their being received in said cavity recesses.

6. The surface mountable connector assembly of claim 5 wherein leading ends of said at least one of said first and second contacts are recessed from said mating face.

7. The surface mountable connector assembly of claim 5 wherein said latch projections extend laterally from said opposed sides of said plug portion and said latch receiving recesses of said receptacle housing are alongside said receptacle sidewalls.

8. The surface mountable connector assembly of claim 2 wherein said latch projections extend laterally from said opposed ends of said plug portion and said latch receiving recesses of said receptacle housing are alongside said receptacle endwalls.

9. The surface mountable connector assembly of claim 5 wherein said latch projections and said latch receiving recesses are proximate corners of the opposed sides or opposed ends of said respective plug and receptacle portions.

10. The surface mountable connector assembly of claim 5 wherein said bearing surfaces of said latch projections are continuously tapered forwardly and inwardly from said latch surface.

11. The surface mountable connector assembly of claim 5 wherein ones of said latch projections on the opposed sides or the opposed ends are aligned with each other.

12. An assembly of interconnectable circuit boards comprising:

a first circuit board having a plurality of first connectors mounted at first connector sites in respective orientations; and a second circuit board having a plurality of second connectors mounted at second connector sites in respective orientations;

said first and second connectors are matable pairs of plug and receptacle connectors;

each said plug connector having a housing with opposed mating and mounting faces and an array of first contacts extending therebetween, said first contacts having mating portions exposed at said mating face for mating with complementary contacts of a mating connector, said mating face being defined on a plug portion of said housing extending between opposed sides and opposed ends, said plug housing including at least two spaced apart latch projections extending laterally from at least both of said opposed sides or both of said opposed ends of said plug portion, and including outwardly facing bearing surfaces extending rearwardly from said mating face;

each said receptacle connector having a housing with opposed mating and mounting faces, a bottom wall and a receptacle portion having opposed sidewalls and opposed endwalls defining a cavity adjacent said bottom wall for receiving said complementary plug connector and a corresponding array of second contacts extending between said mating and mounting faces, said plug portion and receptacle portion being shaped and dimensioned to interfit snugly upon connector mating, said receptacle housing including at least two spaced apart latch receiving recesses adjacent said cavity floor alongside at least both of said sidewalls or both of said endwalls corresponding to said opposed sides or ends of said plug portion having said latch projections, said latch receiving recesses being adapted to receive said latch projections of said plug connector upon full mating thereto;

whereby when said boards are positioned to be moved together to simultaneously mate said pairs of plug and receptacle connectors, said latch projections of said plug housing bear against and create an interference fit with said adjacent housing wall surfaces of said receptacle housing during initial entry of said plug portion into said receptacle portion, thereby holding fixed the centered position of the plug and receptacle connectors to resist lateral forces thereon during mating and upon full mating of said plug and receptacle connectors, said latch projections release said walls upon their being received in said cavity recesses.

13. The assembly of interconnectable circuit boards of claim 12 wherein leading ends of said at least one of said first and second contacts are recessed from said mating face.

14. The assembly of interconnectable circuit boards of claim 12 wherein said latch projections extend laterally from said opposed sides of said plug portion and said latch receiving recesses of said receptacle housing are alongside said receptacle sidewalls.

15. The assembly of interconnectable circuit boards of claim 12 wherein said latch projections extend laterally from said opposed ends of said plug portion and said latch receiving recesses of said receptacle housing are alongside said receptacle endwalls.

16. The assembly of claim 12 wherein said latch projections and said latch receiving recesses are proximate corners of the opposed sides or opposed ends of said respective plug and receptacle portions.

17. The assembly of claim 12 wherein said bearing surfaces of said latch projections are continuously tapered forwardly and inwardly from said latch surface.

18. The assembly of claim 12 wherein ones of said latch projections on the opposed sides or the opposed ends are aligned with each other.

* * * * *